United States Patent [19]

Kawata et al.

[11] 4,425,304

[45] Jan. 10, 1984

[54] CATALYTIC CONVERTER

[75] Inventors: Masayuki Kawata, Higashi Hiroshima; Yoshii: Shinichi, Hiroshima, both of Japan

[73] Assignee: Toyo Kogyo Co., Ltd., Hiroshima, Japan

[21] Appl. No.: 338,953

[22] Filed: Jan. 12, 1982

[30] Foreign Application Priority Data

Jan. 20, 1981 [JP] Japan ..... 56-7638
Feb. 19, 1981 [JP] Japan ..... 56-22801[U]
Feb. 21, 1981 [JP] Japan ..... 56-23914[U]

[51] Int. Cl.[3] ..... B01D 53/36

[52] U.S. Cl. ..... 422/171; 55/DIG. 30; 60/299; 422/177; 422/180

[58] Field of Search ..... 422/171, 172, 177, 180; 60/299, 301, 302, 304; 55/DIG. 30

[56] References Cited

U.S. PATENT DOCUMENTS 4,049,388 9/1977 Scheitlin et al. ..... 60/301 X
4,218,422 8/1980 Schock et al. ..... 422/171
4,235,843 11/1980 Tadokoro et al. ..... 422/171 X
4,238,454 12/1980 Roberts et al. ..... 422/172 X
4,238,456 12/1980 Jalbing ..... 422/172
4,278,639 7/1981 Tadokoro et al. ..... 422/171

FOREIGN PATENT DOCUMENTS 2608843 9/1977 Fed. Rep. of Germany ..... 422/171

*Primary Examiner*—Richard L. Chiesa
*Attorney, Agent, or Firm*—Wenderoth, Lind & Ponack

[57] ABSTRACT

A catalytic converter comprises a generally elongated housing having gas inlet and outlet at its opposite ends, at least first and second catalyst carriers held in position inside the housing in axially spaced relation, a spacer assembly positioned inside the housing between the first and second catalyst carriers for holding them in the axially spaced relation, and an air supply piping having one end adapted to be fluid-connected to a source of fresh air and the other end communicated to the space between the catalyst carriers. The spacer assembly has an axial and a transverse passages defined therein and is constituted by a pair of spacer components prepared from a metal sheet by the use of any known press work.

8 Claims, 10 Drawing Figures

CATALYTIC CONVERTER

BACKGROUND OF THE INVENTION

The present invention generally relates to an exhaust gas purifying apparatus for an automobile internal combustion engine and, more particularly, to a catalytic converter utilizing at least two, in-line monolithic catalyst carriers.

In order to improve the handling capacity of the catalytic converter with respect to a relatively large amount of exhaust gases emitted from an automobile internal combustion engine, the employment of two or more catalyst carriers in one catalytic converter has recently been practiced. The principle lies in that, if the exhaust gases are allowed to pass through as many catalyst carriers containing identical or different catalysts as possible, the exhaust gases can be highly purified.

Where a plurality of catalyst carriers, for example, two catalyst carriers, are employed in one converter housing, it is a conventional practice to use a spacer for holding the catalyst carriers in spaced relation to each other within the housing. In addition, in certain types of conventional catalytic converters, the supply of fresh air, i.e., secondary air, into the space between the catalyst carriers is required to increase the handling capacity of the catalytic converter. This is particularly true where the catalyst carriers positioned on upstream and downstream sides with respect to the direction of flow of the exhaust gases contain reducing and oxidizing catalysts, respectively.

Examples of the prior art catalytic converters utilizing the at least two catalyst carriers with the spacer positioned therebetween, which appear to be pertinent to the present invention, are disclosed in, for example, the U.S. Pat. No. 4,049,388, patented Sept. 20, 1977, and U.S. Pat. No. 4,238,456 patented Dec. 9, 1980.

According to the first mentioned U.S. patent, the supply of secondary air into the space between the reducing and oxidizing catalyst carriers within the housing is effected by means of a piping protruding outwardly from a portion of the housing in a direction opposite to and in alignment with the space between the catalyst carriers. The spacer used therein comprises a pair of mating manifold stampings each having a generally cylindrical connection flange and an outwardly flared wall, the cylindrical connection flange of one manifold stamping being inserted into the cylindrical connection flange of the other manifold stamping with the respective outwardly flared walls extending in opposite directions so as to diverge from the associated connection flanges. In order for the supplied secondary air to enter from the exterior of the spacer into the interior of the spacer, the connection flange of one manifold stamping has a plurality of apertures defined therein whereas the connection flange of the other manifold stamping has a corresponding number of slots defined therein. In an assembled condition of the spacer, the slots and the apertures are exactly aligned with each other.

The catalytic converter according to the first mentioned U.S. patent appears to be disadvantageous in that a complicated and time-consuming, precise connecting procedure is required to connect the manifold stampings together in a manner with the slots exactly aligned with the apertures. Even though the manifold stampings are exactly connected together, there will be a possibility that one manifold stamping once correctly connected with the other manifold stamping will rotate with the slots misaligned with the apertures during the final stage of the make-up of the catalytic converter.

The second mentioned U.S. patent discloses the use of the spacer in the form of a ring in combination with a perforated air supply tubing extending through a portion of the spacer ring and terminating in contact with the opposite portion of the spacer ring. This is complicated in structure and appears to require a relatively large number of component parts, thereby substantially reducing the workability of the converter and increasing the manufacturing cost.

SUMMARY OF THE INVENTION

Accordingly, the present invention has been developed with a view to substantially eliminating the above described disadvantages and inconveniences inherent in the prior art catalytic converters of a similar kind and has for its essential object to provide an improved catalytic converter which can be fabricated with a substantially reduced number of component parts without reducing the handling capacity of the catalyst carriers contained therein.

Another important object of the present invention is to provide an improved catalytic converter of the type referred to above, wherein there is employed a spacer assembly so designed as to increase the rigidity of the housing for the catalytic converter.

A further important object of the present invention is to provide an improved catalytic converter of the type referred to above, wherein the possibility of leakage of exhaust gases flowing within the space between the catalyst carriers is minimized.

A still further object of the present invention is to provide an improved catalytic converter of the type referred to above, which can be manufactured and fabricated at a reduced cost without requiring complicated and time-consuming procedures.

In order to accomplish these objects, the present invention provides an improved catalytic converter which comprises a generally elongated housing having gas inlet and outlet defined at its opposite ends, at least first and second catalyst carriers firmly held in position inside the housing in axially spaced relation to each other, a spacer assembly positioned inside the housing within the space between the first and second catalyst carriers for holding the latter in spaced relation to each other, and an air supply piping having one end adapted to be fluid-connected to a source of fresh air and the other end communicating with the space between the first and second catalyst carriers.

The spacer assembly employed in the catalytic converter according to the present invention has an axial opening defined therein for permitting the flow of the exhaust gases therethrough in a direction generally parallel to the longitudinal axis of the housing and also a transverse passage defined therein so as to extend transversely of the direction of flow of the exhaust gases from the gas inlet towards the gas outlet and so as to communicate with the space between the first and second catalyst carriers. The supply piping communicates with the space between the first and second catalyst carrier through the transverse passage defined in the spacer assembly.

According to the present invention, the spacer assembly is comprised of a pair of spacer components of generally identical construction, each of which spacer components may be fabricated from a metal sheet by the use of any known press work, for example, a stamping technique. These spacer components are so shaped and so joined together as to provide the transverse passage therebetween. Preferably, this spacer assembly is located intermediately of the length of the housing and within the housing in an area of the housing where the rigidity of the housing is generally considered weaker than at the other areas thereof, so that any possible flapping motion of the housing of the catalytic converter, which would result ultimately in cracking, can advantageously be minimized.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE PREFERRED EMBODIMENTS

Figure 1:
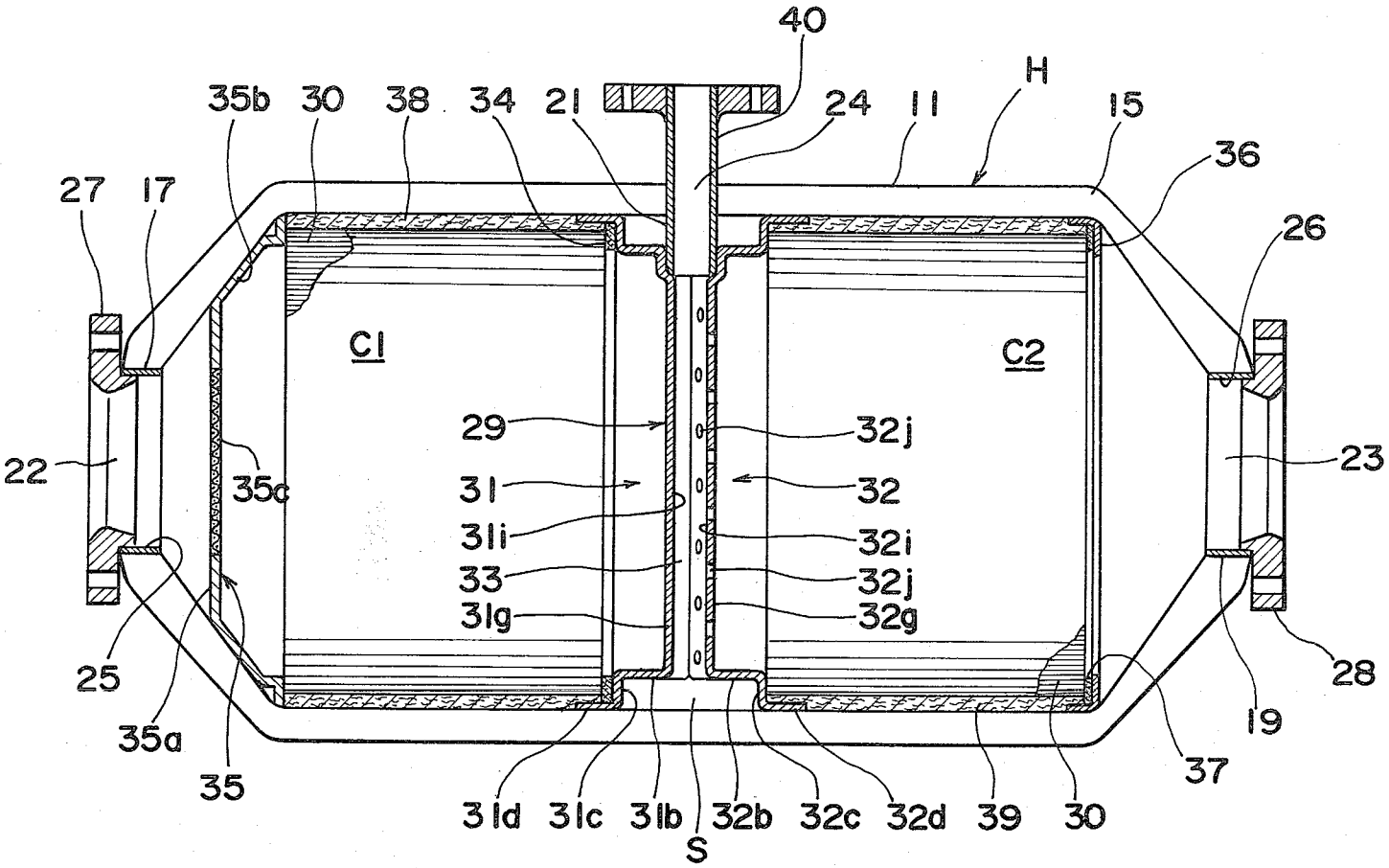
FIG. 1 is a longitudinal top sectional view, on an enlarged scale, of a catalytic converter according to a preferred embodiment of the present invention.

Before the description of the present invention proceeds, it is to be noted that like parts are designated by like reference numerals throughout the accompanying drawings.

Referring to FIGS. 1 to 4, a catalytic converter embodying the present invention and shown therein comprises an elongated, generally flattened housing H preferably made of a metallic material having a sufficient resistance to the corrosive attack of high temperature salts and gases. The converter housing H is comprised of top and bottom housing shells 10 and 11 which include peripheral side walls 12 and 13, respectively, with associated peripheral flanges 14 and 15 extending laterally outwardly therefrom substantially about their entire peripheries. The top and bottom housing shells 10 and 11 are so shaped and so constructed by the utilization of any known press work that, when they are combined together one above the other with the peripheral flanges 14 and 15 welded in abutting face-to-face relation to each other, an elongated, generally flattened chamber can be defined inside the housing H for the accommodation of at least two honeycomb type monolithic catalyst carriers C1 and C2 therein in a manner described hereinbelow.

The opposed portions of the flange 14, and the corresponding portions of the side wall 12, of the top housing shell 10 which correspond in position to the respective opposite ends of the housing H are concaved to provide semicylindrical recesses 16 and 18. In addition, a portion of the flange 14 of the top housing shell 10 which is located substantially intermediately of the length of the housing H is also concaved to provide a semicylindrical recess 20. Similarly, the opposed portions of the flange 15, and the corresponding opposed portions of the side wall 13, of the bottom housing shell 11 which correspond in position to the respective opposite ends of the housing H are concaved to provide semicylindrical recesses 17 and 19, and a portion of the flange 15 and side wall 13 of the bottom housing shell 11 substantially intermediately of the length of the housing H is also concaved to provide a semicylindrical recess 21.

While the top and bottom housing shells 10 and 11 are individually constructed as hereinbefore described, when the top and bottom housing shells 10 and 11 are combined together in the manner described above, these semicylindrical recesses 16 and 18 in the top housing shell 10 cooperate respectively with the semicylindrical recesses 17 and 19 in the bottom housing shell 11 to define an exhaust gas inlet 22 and an exhaust gas outlet 23, respectively, which are coaxial with each other and also with the longitudinal axis of the housing H, whereas the semicylindrical recess 20 in the top housing shell 10 cooperate with the semicylindrical recess 21 in the bottom housing shell 11 to define a bearing hole 24, the function of said bearing hole 24 becoming clear from the subsequent description.

Mounted within the exhaust gas inlet and outlet 22 and 23 are respective connecting rings 25 and 26, the connecting ring 25 being in part received in and welded to the semicylindrical recess 16 and in part received in and welded to the semicylindrical recess 17, while the connecting ring 26 is in part received in and welded to the semicylindrical recess 18 and in part received in and welded to the semicylindrical recess 19. These connecting rings 25 and 26 receive therein respective flanged coupling sleeves 27 and 28 held firmly in position as welded thereto for the external connection with any known exhaust gas supply and discharge pipings (not shown), respectively, it being noted that the terms "exhaust gas supply piping" and "exhaust gas discharge piping" hereinabove used are merely given to denote respective portions of an exhaust system of any known automobile engine which are respectively located upstream and downstream of the catalytic converter with respect to the direction of flow of exhaust gases from the automobile engine towards the atmosphere. Although not shown, the flange of each of the coupling sleeves 27 and 28 may have two or more stud bolts firmly secured thereto, or otherwise welded thereto, so as to extend outwardly of the housing H for the connection with a corresponding flange in the exhaust gas supply or discharge piping.

The catalyst carriers C1 and C2 within the housing H are held in line with each other and in alignment with the longitudinal axis of the housing H, the carrier C1 adjacent the exhaust gas inlet 22 and the carrier C2 adjacent the exhaust gas outlet 23, and spaced in end-to-end fashion by means of a spacer assembly 29 of a construction, which is described in detail below, to define a mixing space S therebetween, which mixing space S is located in position to communicate with the bearing hole 24.

Each of the honeycomb type monolithic catalyst carriers C1 and C2 is generally made of a porous, inert, solid, refractory material in skeletal form with parallel closely adjacent flow passages 30 defined therein and extending throughout the longitudinal extent thereof and has a catalyst deposited on surfaces of macropores communicating with the flow passages 30 and also surfaces defining the flow passages 30. The catalysts deposited on the respective catalyst carriers C1 and C2 are preferably a known reducing catalyst and a known oxidizing catalyst, respectively, and therefore, the catalyst carriers C1 and C2 are hereinafter referred to as reducing and oxidizing catalyst carriers, respectively.

The spacer assembly 29 positioned inside the housing H intermediately between the reducing and oxidizing catalyst carriers C1 and C2 is comprised of first and second spacer components 31 and 32 of generally oval shape similar to the cross-sectional representation of the chamber inside the housing H. The spacer components 31 and 32 are, so far as the embodiment shown in FIGS. 1 to 4 as well as that shown in FIGS. 8 to 10 as is described below are concerned, of generally identical construction and, therefore, only one of them, for example, the spacer component 32, will be described in detail for the sake of brevity.

Figure 2:
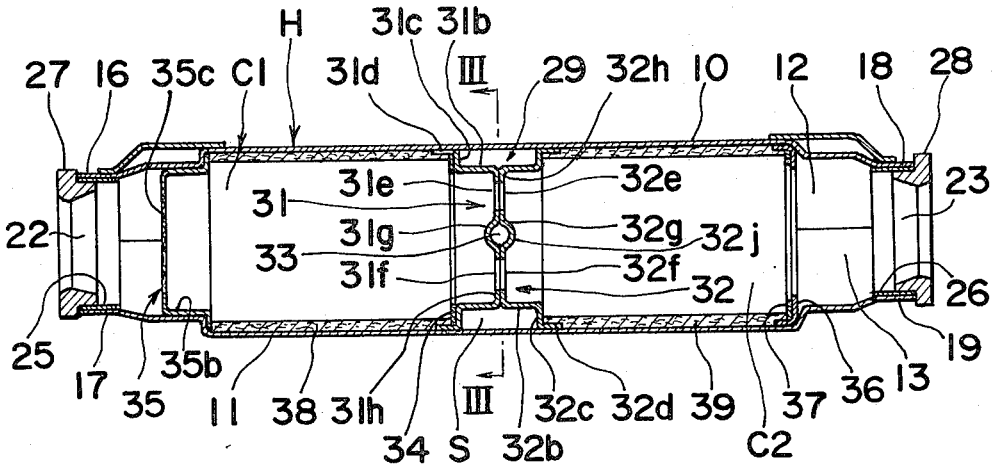
FIG. 2 is a longitudinal side sectional view of the catalytic converter shown in FIG. 1.
Figure 3:
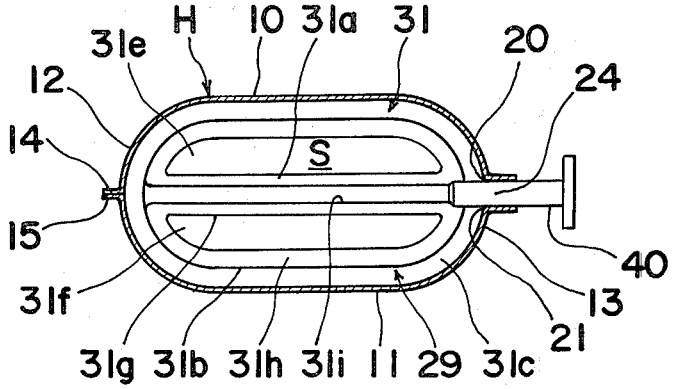
FIG. 3 is a cross-sectional view taken along the line III—III in FIG. 2.
Figure 4:
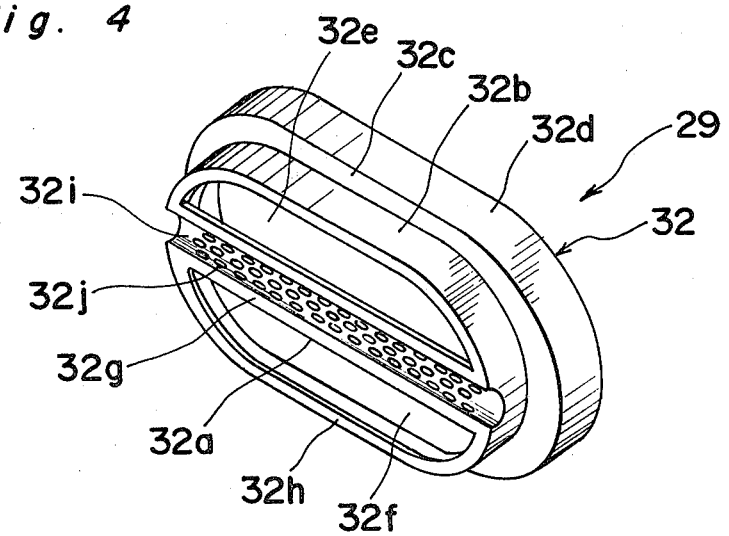
FIG. 4 is a perspective view showing a spacer ring assembly used in the catalytic converter shown in FIGS. 1 to 3.

As best shown in FIG. 4, the spacer component 32 comprises a generally oval-shaped flat wall 32*a*, a peripheral wall 32*b* protruding from the periphery of the wall 32*a* in a direction at right angles to the wall 32*a*, an annular wall 32*c* protruding generally radially outwardly from one peripheral edge of the peripheral wall 32*b* opposite to the flat wall 32*a* and lying in a plane parallel to flat wall 32*a*, and a peripheral flange 32*d* protruding outwardly from one peripheral edge of the annular wall 32*c* opposite to the pheripheral wall 32*b* in a direction at right angles to the annular wall 32*c* and located on one side of said annular wall 32*c* opposite to the peripheral wall 32*b*. The flat wall 32*a* is so blanked at 32*e* and 32*f* as to render the flat wall 32*a* to assume a shape similar to the shape of a figure "θ", that is, as to render the flat wall 32*a* to be defined by a generally elongated transverse wall area 32*g*, extending in alignment with the major axis of the oval or elliptical shape generally assumed by the housing H and corresponding in position to the transverse bar in the shape of the figure "θ", and a generally fringed wall area 32*h* fast with the other peripheral edge of the peripheral wall 32*b* and corresponding to the peripheral edge portion of the flat wall 32*b*. As best shown in FIGS. 2 and 4, the transverse wall area 32*g* is recessed over the entire length thereof so as to provide a trough 32*i* of generally semicircular cross section, the function of which will become clear from the subsequent description.

Elements of the other spacer components 31 which structurally and functionally correspond respectively to the above described elements 32*a* to 32*i* of the spacer component 32 referred to above are designated by reference numerals 31 with corresponding alphabetical symbols affixed thereto, that is, 31*a* to 31*i*, respectively.

Although the spacer components 31 and 32 are of generally identical construction as hereinbefore described, there is a difference therebetween in that a portion of the transverse wall area 32*g* in the spacer component 32 where the trough 32*i* is defined is formed with a plurality of perforations 32*j* whereas that in the spacer component 31 is provided with no perforations.

Each of the spacer components 31 and 32 forming the spacer assembly 29 is of one-piece construction and can be prepared from a metal sheet by the use of any known press work.

When the spacer assembly 29 is fabricated with the fringed wall areas 31*h* and 32*h* in the respective spacer components 31 and 32 contacting, or otherwise welded, in abutting fashion to each other, the troughs 31*i* and 32*i* in the respective spacer components 31 and 32 cooperate with each other to define an air passage 33 of generally circular cross section as best shown in FIGS. 1 and 2.

While the spacer assembly 29 is constructed as hereinbefore described, the peripheral flanges 31*d* and 32*d* in respective spacer components 31 and 32 are plug-welded to the housing H, particularly, the top and bottom housing shells 10 and 11, in a manner with the fringed wall areas 31*h* and 32*h* as well as the transverse wall areas 31*g* and 32*g* held firmly in contact, or otherwise spot-welded, to each other. In this condition, the reducing catalyst carrier C1 within the housing H is held in position with one of its opposite ends contacting the annular wall 31*c* of the spacer component 31 through an elastic pad 34 made of, for example, expanded metal, i.e., a web of steel mesh fabrics, or a knitted web of ceramic fibers known to those skilled in the art, whereas the other of the opposite ends of the reducing catalyst carrier C1 is held in abutting contact with a retainer 35 as is described hereinbelow. On the other hand, the oxidizing catalyst carrier C2 within the housing H is held in position with one of its opposite ends contacting the annular wall 32*c* in the spacer component 32, whereas the other of the opposite ends of the oxidizing catalyst carrier C2 is held in abutting contact with an annular abutment member 36 through an elastic pad 37 which may be identical in construction and material with the elastic pad 34.

The retainer 35 is, as best shown in FIGS. 1 and 2, of a type having a flat area 35*a* and an outwardly flared wall 35*b* having one end integral with the flat area 35*a* and the other end held in abutting contact with the reducing catalyst carrier C1, flat area 35*a* having a wire mesh screen 35*c* rigidly secured thereto in alignment with the exhaust gas inlet 22. It is to be noted that, instead of the employment of the wire mesh screen 35*c*, the flat area 35*a* of the retainer 35 may be formed with a plurality of perforations. In any event, the employment of the wire mesh screen 35*c* or the perforations in the flat area 35*a* of the retainer 35 is advantageous in that exhaust gases to be substantially purified and entering the catalytic converter through the exhaust gas inlet 22 can be rectified before they reach the reducing catalyst carrier C1.

In practice, the reducing and oxidizing catalyst carriers C1 and C2 are wrapped with respective cushioning layers 38 and 39 of, for example, expanded metal or any other known flame-retarded, corrosion-resistant cushioning material, which are, in an assembled condition of the catalytic converter as shown in FIG. 1, positioned between the outer peripheral surfaces of the associated catalyst carriers C1 and C2 and the inner peripheral surface of the housing H.

It is to be noted, that because of the nature of the oxidizing catalyst carrier C2, the spacer assembly 29 within the housing H is positioned in such a manner with the spacer component 32 located adjacent the oxidizing catalyst carrier C2, so that air flowing through the passage 33 in a manner described below can flow through the perforations 32*j* towards the oxidizing catalyst carrier C2.

The catalytic converter embodying the present invention also comprises a secondary air supply pipe 40 having one end plugged in between the spacer components 31 and 32 in fluid-connection with the passage 33 and the other end adapted to be flanged to a secondary air supply conduit (not shown) leading from a source of secondary air which may be constituted by an air pump, a substantially intermediate portion of secondary air supply pipe 40 extending through the bearing hole 24 and welded to that portions of the peripheral flanges 14 and 15 of the respective top and bottom housing shells 10 and 11.

With those various component parts described hereinabove fully described, the catalytic converter according to the present invention is so designed as to operate in the following manner.

Assuming that exhaust gases emitted from the automobile internal combustion engine (not shown) flows into the housing H through the exhaust gas inlet 22, the exhaust gases are first rectified, as they pass through the wire mesh screen 35*c* in the retainer 35, so as to flow uniformly into the flow passages 30 in the reducing catalyst carrier C1. As the exhaust gases flows through the flow passages 30 in the reducing catalyst carrier C1 in contact with the reducing catalyst, reduceable components such as $NO_x$ contained in the exhaust gases are substantially removed.

The exhaust gases subsequently emerging from the reducing catalyst carrier C1 flow into the space S between the reducing and oxidizing catalyst carriers C1 and C2 in the form of a laminar flow. However, as they flow through the communicating openings each defined by the respective blanks 31*e* and 32*e* or 31*f* and 32*f* in the associated spacer components 31 and 32, they are stirred in the presence of the fringed walls 31*h* and 32*h* which project substantially radially inwardly from the associated peripheral walls 31*b* and 32*b* in a manner as to constrict the flow path from one side of the spacer assembly 29 to the other side. Therefore, the exhaust gases ready to enter the flow passages 30 in the oxidizing catalyst carrier C2 are in a turbulent condition and the turbulence of the exhaust gases ready to enter the flow passages 30 in the oxidizing catalyst carrier C2 is further accelerated when the secondary air is supplied under pressure into a portion of the space defined between the spacer component 32 and the oxidizing catalyst carrier C2. As a result of this, the exhaust gases ready to enter the flow passages 30 in the oxidizing catalyst carrier C2 are uniformly mixed with the secondary air so supplied and are then allowed to pass through the flow passages 30 in the oxidizing catalyst carrier C2 towards the exhaust gas outlet 23. As is well known to those skilled in the art, the oxidizing catalyst carrier C2 serves to remove oxidizeable components, such as CO and HC, contained in the exhaust gases, and they are in fact efficiently and effectively removed by the oxidizing catalyst because of the uniform mixing of the gases with the secondary air which has been done in that portion of the space adjacent the oxidizing catalyst carrier C2.

In the foregoing description of the embodiment of FIGS. 1 to 4, it has been described that, while the end of the secondary air supply pipe 40 is inserted into the passage 33, the substantially intermediate portion of the secondary air supply pipe 40 is rigidly secured or welded to that portions of the peripheral flanges 14 and 15 of the respective top and bottom housing shells 10 and 11 where the bearing hole 24 is defined. This is particularly advantageous in that, since the end portion of the supply pipe 40 is inserted into the passage 33, the possibility of a portion of the exhaust gases leaking to the outside of the housing H through the bearing hole 24 can be minimized.

However, in accordance with other embodiments of the invention, the secondary air pipe 40 may not be fluid-connected directly to the passage 33 defined between the spacer components 31 and 32 of the spacer assembly and this will be described with particular reference to FIGS. 5 to 7 and FIGS. 8 to 10.

Figure 5:
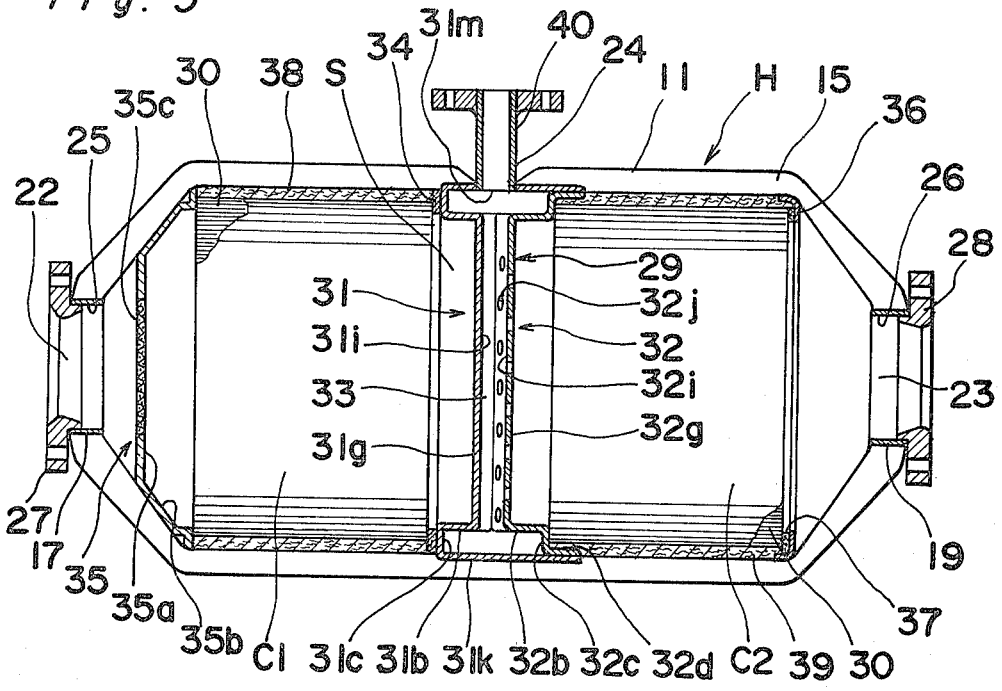
FIGS. 5 to 7 are views similar to FIGS. 1 to 3, respectively, showing the catalytic converter according to another preferred embodiment of the present invention.
Figure 6:
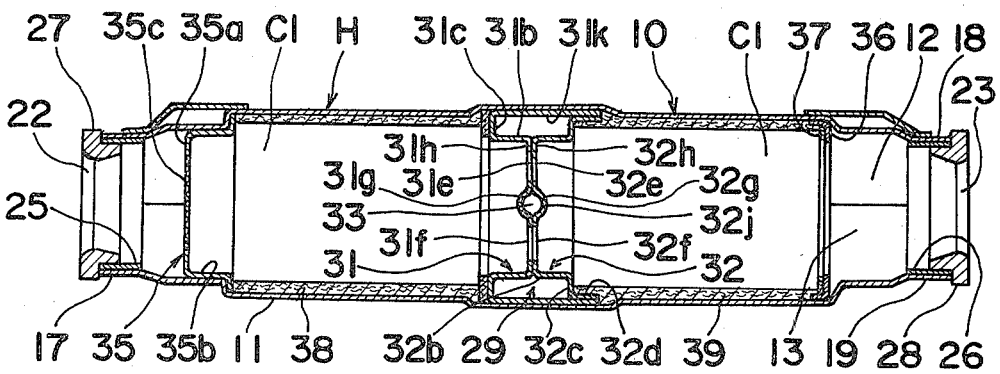
Figure 7:
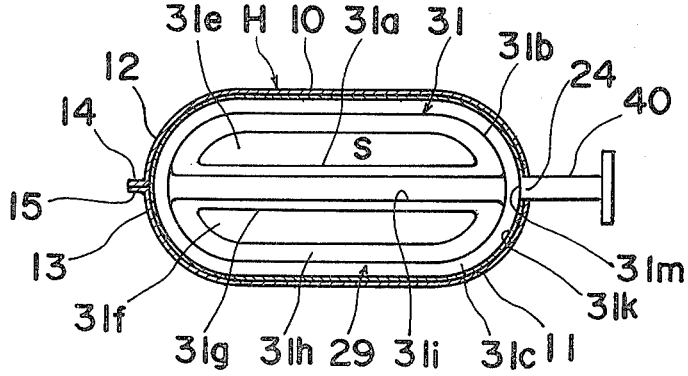

Referring first to FIGS. 5 to 7, the embodiment shown therein differs from that shown in FIGS. 1 to 4 substantially only in the fluid-connection between the secondary air supply pipe 40 and the passage 33. More specifically, the end of the secondary air supply pipe 40 is rigidly connected, or otherwise welded about its entire outer periphery, to the spacer assembly 29 with an annular space intervening between the secondary air supply pipe 40 and the passage 33. For this purpose, only one of the spacer components of the spacer assembly 29, for example, the first spacer component 31 so far illustrated, is provided, instead of the peripheral wall 31*d* described as employed in the foregoing embodiment, with a cover-up wall 31*k* integral with the spacer component 31 and protruding outwardly from one peripheral edge of tne annular wall 31*c* so as to overlay the peripheral wall 31*b* in equally spaced relation thereto, the outermost peripheral edge portion of said cover-up wall 31*k* opposite to the annular wall 31*c* being sealed to the peripheral flange 32*d* of the spacer component 32 by welding so that a substantially sealed annular space can be defined in the spacer assembly 29 externally of the peripheral walls 31*b* and 32*b* and internally of the cover-up wall 31*k* and between the annular walls 31*c* and 32*c*.

The cover-up wall 31*k* has an aperture defined therein at 31*m* in alignment with the bearing hole 24 in the housing H, and the end of the secondary air supply pipe 40 is sealingly welded to the peripheral lip region defining the aperture 31*m*. As is the case with the foregoing embodiment, a portion of the secondary air supply pipe 40 adjacent the aperture 31*m* is sealingly welded to that portions of the peripheral flanges 14 and 15 of the respective top and bottom housing shells 10 and 11.

Even the arrangement shown in FIGS. 5 to 7 assures a sealability similar to that afforded by the arrangement shown in FIGS. 1 to 4.

Figure 8:
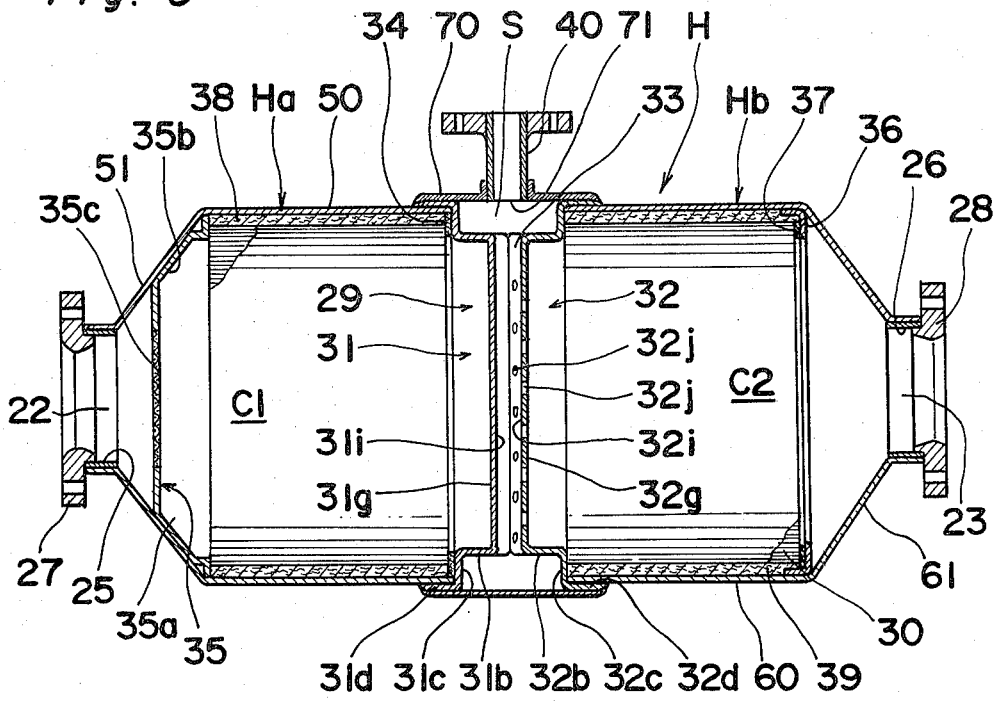
FIGS. 8 to 10 are views similar to FIGS. 1 to 3, respectively, showing the catalytic converter according to a further preferred embodiment of the present invention.
Figure 9:
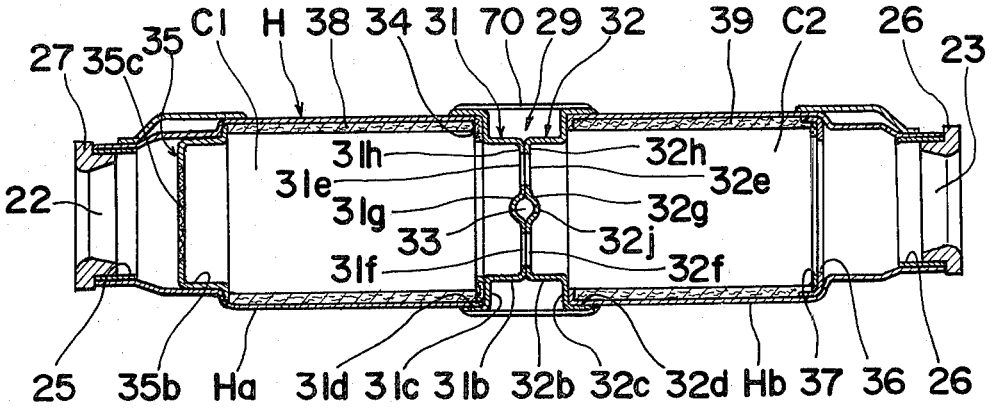
Figure 10:
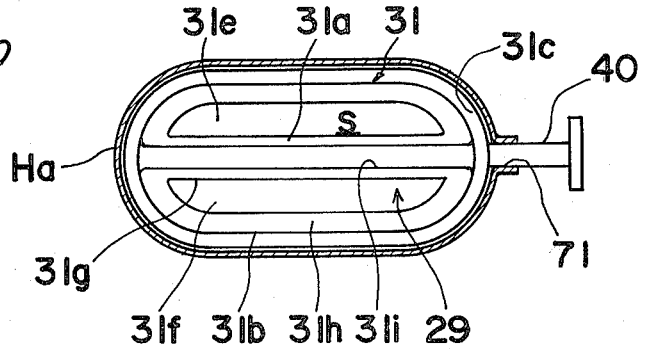

Referring now to FIGS. 8 to 10, although the embodiment shown therein employs the spacer assembly 29 of the construction described with reference to FIGS. 1 to 4, the housing H employed therein differs from that employed in any one of the foregoing embodiments. Specifically, the housing H shown therein comprises a pair of housing halves Ha and Hb of substantially identical construction which are so shaped that, when they are connected in end-to-end fashion as is described below, the assembly assumes a shape similar to the housing described as constituted by the top and bottom housing shells 10 and 11 in the foregoing embodiments. More specifically, as best shown in FIGS. 8 and 9, housing halves Ha or Hb respectively generally elliptically cross-sectioned hollow bodies 50 or 60 respectively having one end formed integrally with a flared end walls 51 and 61 protruding outwardly therefrom so as to converge and terminating so as to respectively define the exhaust gas inlet 22 and the exhaust gas outlet 23.

The housing H shown in FIGS. 8 to 10 also comprises a generally elliptical endless band 70 of a material similar to or identical with the material for the housing H used in the foregoing embodiments, endless band 70 having a width equal to or slightly greater than the span between the outermost peripheral edges of the respective peripheral flanges 31*d* and 32*d* of the associated spacer components 31 and 32. In an assembled condition as best shown in FIGS. 8 and 9, the other ends of the housing halves Ha and Hb remote from their exhaust gas inlet and outlet 22 and 23 are received in respective bores defined by the peripheral flanges 31*d* and 32*d* and the annular walls 31*c* and 32*c*, with the outermost peripheral edges of the respective peripheral flanges 31*d* and 32*d* welded sealingly to the outer peripheral surfaces of the associated hollow bodies Ha and Hb. The endless band 70 is in turn mounted on the housing H externally of the spacer assembly 29 so as to enclose the annular space with the opposite ends thereof welded sealingly to the outer peripheral surfaces of the associated hollow bodies Ha and Hb in overlapping relation with the respective peripheral flanges 31*d* and 32*d*.

As is the case in the cover-up wall 31*k* employed in the foregoing embodiment of FIGS. 5 to 7, the endless band 70 has an aperture defined therein at 71 in alignment with the passage 33, and the end of the secondary air supply pipe 40 is sealingly welded to the peripheral lip region defining the aperture 71. Alternatively, the end of the secondary air supply pipe 40 may be inserted into the air passage 33 while a substantially intermediate portion thereof is sealingly welded to the peripheral lip region defining the aperture 71, in a substantially similar manner to the connection of the pipe 4 to the passage 33 used in the embodiment of FIGS. 1 to 4.

From the foregoing full description of the present invention, it has now become clear that, in view of the fact that the spacer assembly 29 is positioned intermediately between the catalyst carriers C1 and C2 and rigidly secured to the housing H at an area where the rigidity of the housing H is generally considered weaker than at the other areas of the housing H, any possible flapping motion of the housing H of the catalytic converter which would occur under the influence of vibrations of the internal combustion engine and/or the pulsating flow of the exhaust gases can advantageously be minimized or suppressed, thereby minimizing the possibility of cracking of the housing H. Therefore, this brings about the prolonged durability of the catalytic converter constructed according to the present invention.

Although the present invention has been fully described in connection with the preferred embodiments thereof with reference to the accompanying drawings, it is to be noted that various changes and modifications are apparent to those skilled in the art. By way of example, although in describing the preferred embodiments of the present invention reference has been made to the employment of the two catalyst carriers C1 and C2, three or more catalyst carriers arranged in line with each other may be employed. In such case, the spacer assembly 29 should be positioned between every two adjacent catalyst carriers. However, in the case of the embodiment shown in the FIGS. 8 to 10, one or more intermediate elliptical barrels for accommodating therein one or more extra catalyst carriers are additionally required to make up the housing H.

In addition, the cross-sectional shape of the housing H is not limited to the oval or elliptical shape, but may be circular or any other shape.

Such changes and modifications are to be understood as included within the true scope of the present invention unless they depart therefrom, accordingly.

We claim:

1. A catalytic converter for effecting substantial purification of exhaust gases by catalytic reaction, which comprises, in combination:

a generally elongated housing having at one end an inlet for receiving the exhaust gases and at the other end an outlet for discharging the exhaust gases which have been passed through said housing;

at least first and second monolithic catalyst carriers housed within said housing in longitudinally spaced relation to each other and located on respective sides adjacent said inlet and said outlet, each of said catalyst carriers having a plurality of parallel closely adjacent flow passages extending throughout the length thereof;

a spacer assembly positioned inside said housing and within an intermediate space between said first and second catalyst carriers for holding said first and second catalyst carriers in said longitudinally spaced relation and having an axial passage and a transverse passage defined therein, said axial passage extending in said intermediate space across said spacer assembly in a direction parallel to the direction of flow of the exhaust gases, said transverse passage extending in a direction generally perpendicular to the direction of flow of the exhaust gases, said spacer assembly comprising first and second spacer components, each of said first and second spacer components generally comprising an annular wall having an opening defined therein, a transverse wall having perforations defined therein and extending across said opening with opposite ends thereof integral with said annular wall, and a support wall protruding from said annular wall and terminating in rigid securement to said housing, said transverse wall of at least one of said first and second spacer components having a recess defined therein, said first and second spacer components being connected together with the annular wall thereof held in abutting face-to-face relation to each other and with the support walls of said first and second spacer components protruding from the annular walls thereof in opposite directions away from each other, and wherein said axial passage is defined by portions of the openings in said annular walls on respective sides of the transverse walls of said first and second spacer components and said transverse passage is defined by said recess in said transverse wall of said at least one of said first and second spacer components; and an air supply piping having one end adapted to be fluid-connected to a source of air and the other end fluid-connected to said intermediate space through said transverse passage.

2. A catalytic converter for effecting substantial purification of exhaust gases by catalytic reaction, which comprises, in combination:

a generally elongated housing having at one end an inlet for receiving the exhaust gases and at the other end an outlet for discharging the exhaust gases which have been passed through said housing;

at least first and second monolithic catalyst carriers housed within said housing in longitudinally spaced relation to each other and located on respective sides adjacent said inlet and said outlet, each of said catalyst carriers having a plurality of parallel closely adjacent flow passages extending throughout the length thereof;

a spacer assembly positioned inside said housing and within an intermediate space between said first and second catalyst carriers for holding said first and second catalyst carriers in said longitudinally spaced relation and having an axial passage and a transverse passage defined therein, said axial passage extending in said intermediate space across and spacer assembly in a direction parallel to the direction of flow of the exhaust gases, said transverse passage extending in a direction generally perpendicular to the direction of flow of the exhaust gases, said spacer assembly comprising first and second spacer components, and an air supply piping having one end adapted to be fluid-connected to a source of air and the other end fluid-connected to said intermediate space through said transverse passage; each of said first and second spacer components generally comprising an annular flat wall having an opening defined therein, lying in a plane perpendicular to the direction of flow of the exhaust gases in said housing and having a transverse wall extending across said opening with its opposite ends integral with the inner peripheral edge of said annular flat wall, and a support wall protruding outwardly from the outer peripheral edge of said annular flat wall and terminating in rigid securement to said housing, said transverse wall and the opposite portions of said annular flat wall, which are aligned with said transverse wall, being recessed to assume a generally semicircular cross section, the transverse wall of at least one of said first and second spacer components having perforations therein, said first and second spacer components being connected together with the annular flat walls thereof held in abutting face-to-face relation to each other with the support walls of said first and second spacer components protruding outwardly from the annular flat walls thereof in opposite directions away from each other, and wherein said axial passage is defined by portions of the openings in said annular flat walls on respective sides of the transverse walls of said first and second spacer components and said transverse passage is defined by the recesses defined in said transverse walls and said opposite portions of said annular flat walls of said first and second spacer components.

3. A converter as claimed in claim 1, wherein said at least one of the first and second spacer components is said second spacer component.

4. A converter as claimed in claim 1, 2 or 3, wherein said other end of said air supply piping is inserted a predetermined distance into said transverse passage, a substantially intermediate portion of said piping, which extends through said housing, being sealingly connected to said housing.

5. A converter as claimed in claim 1, 2 or 3, wherein said support wall of one of the first and second spacer components has a cover-up wall extending outwardly therefrom in a direction parallel to the direction of flow of the exhaust gases and terminating in overlapping relation with an outer peripheral edge portion of the support wall of the other of said first and second spacer components.

6. A converter as claimed in claim 5, wherein said other end of said air supply piping is sealingly connected to said cover-up wall in communication with said transverse passage through an annular space defined by the support walls of said first and second spacer components.

7. A converter as claimed in claim 1, wherein each of said first and second spacer components are formed from a metal sheet.

8. A converter as claimed in claim 2, wherein each of said first and second spacer components are formed from a metal sheet.

* * * * *